US005494716A

United States Patent [19]

Seung et al.

[11] Patent Number: 5,494,716

[45] Date of Patent: Feb. 27, 1996

[54] DUAL-OVENABLE FOOD TRAYS

[75] Inventors: Norman Seung, Monroe, N.Y.; Neil Matheson, III, Garland; Robert Dillon, Lucas, both of Tex.

[73] Assignee: International Paper Company, Purchase, N.Y.

[21] Appl. No.: 248,919

[22] Filed: May 25, 1994

[51] Int. Cl.[6] ..... B65D 81/34; B32B 27/10; C09D 133/06; C09D 125/14

[52] U.S. Cl. ..... 428/34.2; 428/514; 523/100; 524/501; 524/522; 524/523; 525/221; 525/228

[58] Field of Search ..... 525/221, 228; 524/501, 522, 523; 428/34.2, 514; 523/100

[56] References Cited

U.S. PATENT DOCUMENTS

| | | | |
|---|---|---|---|
| 2,961,421 | 11/1960 | Cohen | 428/34.2 |
| 2,972,592 | 2/1961 | Brown | 524/501 |
| 3,058,938 | 10/1962 | Lindstrom | 525/514 |
| 3,728,418 | 4/1973 | Gleason | 525/221 |
| 4,775,560 | 10/1988 | Katsura | 428/34.2 |

*Primary Examiner*—David Buttner
*Attorney, Agent, or Firm*—Michael J. Doyle

[57] ABSTRACT

A dual ovenable food tray having both high temperature resistance and superior food release properties is prepared by applying to at least one surface of a paperboard substrate an aqueous coating formulation comprising a styrene-acrylic latex having a low $T_g$, a styrene-acrylic latex having a high $T_g$ or a mixture thereof, wherein the coating formulation preferably further comprises at least one additional component selected from coalescing solvents, thickening agents, defoaming agents, crosslinkers and wax emulsions.

2 Claims, No Drawings

DUAL-OVENABLE FOOD TRAYS

FIELD OF INVENTION

The invention relates to the field of dual ovenable food trays comprising a paperboard substrate coated with an aqueous coating composition in order to obtain a food tray having high temperature resistance and good food release properties.

BACKGROUND OF THE INVENTION

In the past, the most common type of food container for frozen foods and other pre-prepared food products which are to be heated within the container were constructed of thin aluminum sheets and covered with an aluminum foil. While these aluminum trays are excellent for conventional oven cooking, they are costly and cannot be used in microwaves. Due to the increased popularity of microwave cooking, substantial efforts have been made to provide alternative containers which are suitable for both conventional oven and microwave oven cooking. A dual ovenable food tray has become an industrial objective.

Typically, dual ovenable food trays comprise a plastic-coated paperboard substrate. Although polyethylene and other common plastics have been used as a coating material due to their good moisture impermeability and good adherence to paperboard, such plastics tend to melt at high oven temperatures. For example, polyethylene terephthalate (PET) has found widespread popularity in coating compositions for paperboard substrates due to its high melting temperature and structural strength. However, food trays coated with PET-based coating compositions are generally limited for use in oven temperatures up to about 350° F. At higher temperatures, PET-coated food trays tend to undergo severe deformation, e.g., curling, and lose their shape. Further, food tends to stick to PET-based coatings since such coatings generally exhibit poor food release properties.

Aqueous coating formulations have also been developed for coating paperboard substrates for use as food trays. For example, U.S. Pat. No. 4,418,119 to Morrow describes a paperboard or similar substrate coated first with a polyvinyl alcohol and then with a silicone. In U.S. Pat. No. 4,421,825 to Seiter, a two layer coating is provided, the first layer being an acrylic polymer comprising titanium dioxide and the second layer being a clear acrylic copolymer. U.S. Pat. No. 4,775,560 to Katsura teaches the use of an aqueous dispersion of an epoxy-acrylic resin/hiding pigment as a coating material for a heat resistant container.

Despite the many types of coating materials known in the prior art for preparing food trays, there still exists a need for a dual ovenable food tray which exhibits both high temperature resistance and superior food release properties. The coating material providing these properties should also be inexpensive to produce and apply, should with minimal modification find application in less demanding environments, such as frozen food cartons, liquid packaging, fresh foods and non-foods.

SUMMARY OF THE INVENTION

Accordingly, it is an object of the present invention to provide a food tray which exhibits both high temperature resistance and good food release properties.

It is another object of the present invention to provide an aqueous coating formulation which will provide a substrate material with both high heat resistance and superior food release properties.

It is an additional object to provide an aqueous coating formulation which can be utilized in the dual ovenable food tray market as well as in less demanding applications, such as frozen food cartons, liquid packaging, and packaging for fresh foods and non-foods.

It is another object of the present invention to provide a dual ovenable food tray coated with an aqueous coating formulation that performs without browning and emission of odors during cooking.

It is still another object of the present invention to provide a dual ovenable food tray having grease barrier and water barrier properties.

It is a further object of the present invention to provide a dual ovenable food tray having good heat sealability and moderate crease-resistance.

It is an additional object of the present invention to provide a food tray which may be used in both conventional oven cooking and microwave cooking.

It is yet another object of the present invention to provide a resin coated dual ovenable food tray wherein all the components of the resin coating formulation are generally denoted as GRAS (Generally Recognized As Safe) for direct food contact under FDA packaging guidelines, and wherein the resin coating formulation is applied as an aqueous composition.

Additional objects, advantages and novel features of the invention will be set forth in part in the description which follows.

These and other objects of the invention, as embodied and broadly described herein, are achieved by providing a dual ovenable food tray comprising a paperboard substrate coated with an aqueous coating formulation comprising at least one styrene-acrylic latex and, preferably, at least one additional component selected from coalescing solvents, thickening agents, defoaming/dispersing agents, crosslinking agents and wax-containing emulsions.

DETAILED DESCRIPTION

The present invention relates to a food tray having both high temperature resistance and superior food release properties. More specifically, the present invention relates to an aqueous coating formulation and its use in the fabrication of a dual ovenable food tray. The aqueous coating formulation may be applied to any conventional substrate and preferably is applied to a paperboard substrate.

The aqueous coating formulations of the present invention are based on styrene-acrylic latexes. Preferably, the formulation comprises (a) water; (b) an aqueous latex containing a relatively soft free carboxyl group-containing styrene-acrylic resin having a low glass transition temperature ($T_g$) of from about 20° C. to about 80° C., and preferably from about 20° C. to about 30° C.; and/or an aqueous latex containing a relatively hard carboxyl group-containing styrene-acrylic resin having a high glass transition temperature ($T_g$) of from about 55° C. to about 80° C., and preferably from about 55° C. to about 65° C. Preferably, the present aqueous coating formulations also comprise one or more adjuvants for improving the physical and/or mechanical properties of the food trays on which the formulations are applied. Suitable adjuvants include, for example, coalescent solvents, such as polyols, thickening agents, defoaming/dispersing agents, and agents for improving the food release, grease barrier, water barrier, blocking resistance, crease-resistance, etc. properties of the coated food trays. Other additives, such as aqueous ammonia, can be added to adjust the pH of the coating formulations. Preferably these adjuvants will be denoted GRAS for direct food contact under Food and Drug Administration guidelines.

Suitable low $T_g$ carboxyl group-containing styrene-acrylic latexes include, for example, B. F. Goodrich's Carboset XPD-1103, ($T_g$ approximately 20° C.), whereas suitable high $T_g$ carboxyl group-containing styrene-acrylic latexes include B. F. Goodrich's Carboset XPD-1105, ($T_g$ approximately 55° C.). The relative amount of low and high $T_g$ styrene-acrylic latexes that is used in the present coating formulations is dependent upon the latexes that are employed. Typically, however, the coating formulations will comprise from about 0 to about 100 wt. %, and preferably from about 30 wt. % to about 70 wt. % low $T_g$ styrene-acrylic latex (based on the weight of the resin solids (BORS) in the total formulation) and from about 100 wt. % to about 0 wt. %, and preferably from about 70 wt. % to about 30 wt. % (BORS) of the high $T_g$ styrene-acrylic latex, wherein each of the styrene-acrylic latexes will comprise from about 50 wt. % resin solids. Generally speaking, it has been found that using a relatively higher percentage of the styrene-acrylic latex having a low glass transition temperature results in a coating formulation which lends itself to lower processing temperatures; whereas using a relatively higher percentage of a styrene-acrylic latex having a high $T_g$ results in a coating formulation which requires higher processing temperatures. However, it has also been found that if too much low $T_g$ styrene-acrylic latex is used, the coating on the substrate will exhibit haze and/or tackiness; whereas if too much high $T_g$ styrene-acrylic latex is used, it is difficult to form pin-hole free and crack-free coatings. The use of too much high $T_g$ styrene-acrylic latex also requires the use of relatively higher coating processing temperatures, e.g., higher than about 280° F. Typically, the coating formulations of this invention are processed at temperatures between about 220° F. and 300° F., e.g., about 280° F.

As indicated previously, the coating formulations of this invention may comprise a coalescent solvent. Such a coalescing solvent, which may comprise, for example, a food grade polyol such as propylene glycol or glycerine, helps lower the minimum film forming temperature of the coating formulation, particularly when higher amounts of high $T_g$ styrene-acrylic latex are used. When present, the coalescing solvent may be used in amounts up to about 20% by weight, and preferably in amounts up to about 15 wt. %, and more preferably in amounts up to about 10 wt. % BORS.

Thickeners and other rheology modifying agents can be added to the instant formulation in amounts up to about 2 wt. %, preferably from about 0.1% to about 1.0 wt. %, and more preferably from about 0.25 wt. % to about 0.75 wt. % BORS. Suitable thickeners include, for example, GRAS acrylic polymers, such as polyacrylic acid, clays, such as Bentonite; cellulosics. Preferably the thickening agent is a food grade carboxylmethylcellulose or a polyacrylic acid copolymer, such as Rohm & Haas Co. Acrysol ASE-60 (an acrylic copolymer emulsion).

The coating formulation also may comprise up to about 1 wt. %, preferably up to about 0.8 wt. %, and more preferably up to about 0.5 wt. %, based on the total weight of the formulation, of a conventional food grade defoaming/dispersing agent. Suitable defoaming/dispersing agents include, for example, Colloid 963, a proprietary composition available from Rhone-Poulenc. The defoaming/dispersing agent functions primarily to reduce the number of bubbles in the final coating.

The coating formulations of the present invention may further comprise up to about 15 wt. %, preferably up to about 10 wt. %, and more preferably up to about 8 wt. %, BORS, of a food grade crosslinker, such as the melamine-formaldehyde resin Cymel 373 (available from Cytec Industries); and up to about 40 wt. %, preferably up to about 30 wt. %, and more preferably up to about 20 wt. % BORS, of a food grade wax, such as that from the carnauba wax emulsion Michemlube 160 (available from Michelman, Inc.) to improve the food release properties of the final coated trays. Typically, the wax emulsion will contain from about 15 wt. % to about 50 wt. % wax solids, e.g., about 25 wt. %.

The coating compositions of the present invention may further comprise other additives in order to provide additional properties, for example water impermeability agents, grease barrier agents, etc. Additionally, conventional additives, such as pigments, colorants and the like may be used in the present coating composition. Additionally, aqueous ammonia may be added to adjust the pH of the coating compositions.

The coating formulations of the present invention may be summarized as follows:

TABLE 1

| Component | Wt. % (Broad Range) | Wt. % (Preferred Range) |
|---|---|---|
| Low $T_g$ Styrene-Acrylic Latex | 0–100 (BORS) | 30–70 |
| High $T_g$ Styrene-Acrylic Latex | 100–0 (BORS) | 70–30 |
| Coalescent Solvent | 0–20 (BORS) | 0–10 |
| Thickening Agent | 0–2 (BORS) | 0.25–0.75 |
| Defoaming Agent | 0–1 | 0–0.5 |
| Crosslinker | 0–15 (BORS) | 0–8 |
| Wax | 0–40 (BORS) | 0–20 |

The coating formulations of the present invention may be applied to a food tray substrate, such as a paperboard substrate, in any manner known in the art. For example, the coating formulations of this invention may be applied to a paperboard substrate by means of a blade, air knife or rod coater using coating weights in the range of from about 0.2 to about 20.0 lbs/3MSF, preferably from about 3.0 to about 15.0 lbs/3MSF, and more preferably from about 8.0 to about 10.0 lbs/3MSF. The coating typically is applied to a non-clay coated side of a substrate material using a single bump/single pass coating format or, more preferably, a multiple bump format which enables better control of the properties of the final coated product. For example, it has been found that pin-hole free coatings can be obtained more effectively by applying a given weight of coating formulation in three light bumps of coating material, rather than applying two heavier bumps or by applying the entire amount of the coating formulation in a single heavy bump. Additionally, using a multiple bump coating format enables the application of multiple layers of coating materials having different compositions. For example, when a wax-containing coating composition is to be used to improve the food release properties of a coated tray, it is preferable to add wax only to the uppermost layer (topcoat), since the low surface energy of the wax may cause a wetting problem with any subsequently applied coating layer. Accordingly, when a wax-containing topcoat is used, a preferred structure would comprise either a topcoat-basecoat-paperboard combination or a topcoat-basecoat-basecoat-paperboard combination.

The coatings of the present invention have been coated on some milk carton base stock and such coated board has been used as containers for the cooking of a variety of frozen food using a conventional oven. For examples, the Michelina's brand "Pasta in a Cream Sauce with Chicken" were cooked at 350° F. for 27 minutes. The Pillsbury's brand "Grands Southern Style Biscuits" were baked at 375° F. for 14 minutes. The Budget Gourmet brand "Pepper Steak with Rice," "Three Cheese Lasagna," and "Fettucini Alfredo with Four Cheeses" were cooked at 375° F. for 30 minutes. The Banquet brand "Chicken Pot Pie" was baked at 375° F. for 35 minutes. The Mrs. Paul's brand fish sticks were baked at 400° F. for 19 minutes. In all the above-mentioned examples, there is no grease or food juice penetration through the coated board after cooking. The food release is very good and there is minimal amount of residual food sticking to the coated board; and there is minimal curling or deformation of the coated board.

The coated board of the present invention can be used for a variety of food groups. For examples, pasta, rice, bakery, meat and fish.

While particular embodiments of the invention have been described, it will be understood, of course, that the invention is not limited thereto, and that many obvious modifications and variations can be made, and that such modifications and variations are intended to fall within the scope of the appended claims.

We claim:

1. A dual ovenable food tray comprising a paperboard substrate which is coated on at least one side thereof with a coating composition comprising:

a) from about 30 to about 70 wt. % BORS of a styrene-acrylic latex having a low $T_g$ of from about 20° C. to about 30° C.;

b) from about 70 to about 30 wt. % BORS of a styrene-acrylic latex having a high $T_g$ of from about 55° C. to about 65° C.;

c) from about 0 to about 20 wt. % BORS of a coalescing solvent;

d) from about 0 to about 2 wt. % BORS of a thickening agent;

e) from about 0 to about 1 wt. % BORS of a defoaming/dispersing agent; and f) the balance water.

2. A dual ovenable food tray according to claim 1, wherein the coating composition comprises from about 30 wt. % to about 70 wt. % of said styrene-acrylic latex having said low $T_g$; from about 70 wt. % to about 30 wt. % of said styrene-acrylic latex having said high $T_g$; from 0 wt. % to about 10 wt. % BORS coalescing solvent; from about 0.25 wt. % to about 0.75 wt. % BORS thickening agent; from 0 wt. % to about 0.5 wt. % defoaming/dispersing agent; and further comprising from about 0 wt. % to about 8 wt. % BORS crosslinker; and from 0 wt. % to about 20 wt. % BORS wax.

* * * * *